United States Patent [19]

Sumiyoshi

[11] Patent Number: 4,746,315

[45] Date of Patent: May 24, 1988

[54] PRODUCTION OF COLOR SELECTION MECHANISM FOR CATHODE-RAY TUBE

[75] Inventor: Hiroji Sumiyoshi, Tokyo, Japan

[73] Assignee: Sony Corporation, Tokyo, Japan

[21] Appl. No.: 877,479

[22] Filed: Jun. 23, 1986

[30] Foreign Application Priority Data

Jun. 27, 1985 [JP] Japan ..... 60-140918

[51] Int. Cl.[4] ..... H01J 9/00

[52] U.S. Cl. ..... 445/37

[58] Field of Search ..... 445/37, 47, 49; 313/407

[56] References Cited

U.S. PATENT DOCUMENTS

| | | | |
|---|---|---|---|
| 2,898,494 | 4/1959 | Haas | 313/407 |
| 3,737,703 | 6/1973 | Tsuneta et al. | 445/37 X |
| 3,916,243 | 10/1975 | Brown | 445/47 X |

FOREIGN PATENT DOCUMENTS

| | | | |
|---|---|---|---|
| 3341 | 1/1982 | Japan | 445/47 |

*Primary Examiner*—Kenneth J. Ramsey

*Attorney, Agent, or Firm*—Hill, Van Santen, Steadman & Simpson

[57] ABSTRACT

A process of producing a color selection mechanism for a cathode-ray tube which eliminates operations such as heat treatment at a high temperature for annealing and processing with levellers, to simplify production steps and resolves problems of rejects and dependability due to segregation of components involved in the stamping operation of a conventional process. A color selection electrode having a plurality of electron beam-passing openings formed therein is merely bent within the elastic limit of the material of the electrode, without causing a drawing effect, into a curved facial shape having substantially a cylindrical face as a basic facial shape thereof, and is permanently mounted in the curved condition on a frame to form a color selection mechanism.

3 Claims, 8 Drawing Sheets

PRODUCTION OF COLOR SELECTION MECHANISM FOR CATHODE-RAY TUBE

BACKGROUND OF THE INVENTION

This invention relates to a process of producing a color selection mechanism for a cathode-ray tube such as a color television image receiving tube and/or a color display apparatus.

A typical conventional color cathode-ray tube is shown in a diagrammatic cross-sectional view of FIG. 1. Referring to FIG. 1, a cathode-ray tube body 1 includes a panel section 1P, a funnel section 1F. and a neck section 1N. The panel section 1P has a panel 2*a* having a color fluorescent screen 3 formed on an inner face of the panel 2*a*, and a skirt 2*b* formed in an integral relationship with and extending from a periphery of the panel 2*a* to the funnel section 1F and having an end face secured by fritting to an end face of an opening of the funnel section 1F. A color selection electrode 4 having a plurality of electron beam-passing openings 4*a* perforated therein, such as, for example, a shadow mask, is disposed within the pannel section 1P in an opposing relationship to the color fluorescent screen 3 formed on the inner face of the panel 2*a* so that, for example, three electron beams R, G and B corresponding to red, green and blue colors, respectively, may land on corresponding fluorescent patterns for the respective colors on the color fluorescent screen 3. Reference numeral 7 denotes means for deflecting the electron beams R, G and B in horizontal and vertical directions.

The color selection electrode 4, for example, a shadow mask, is normally produced by perforating a great number of openings such as round holes or elongated holes in rows and columns in a cold rolled steel plate material of a thickness of 0.08 to 0.35 mm using a photochemical process. Such a process comprises photolithography and then stamping, (drawing) the steel plate into a required facial shape, that is, a shape corresponding to the shape of the curved face of the panel 2*a* of the cathode-ray tube body, and generally into a segmental spherical shape. The color selection mechanism 6 is constructed by welding a periphery of the color selection electrode 4 to a support frame 5.

However, when a color selection electrode is to be produced by stamping a metal plate material in this manner, an annealing operation is required to process the metal plate material at a temperature of 850° C. to 950° C. within a reducing atmosphere prior to such stamping so that a possible elongation by 1 to 3 per cent of the metal plate material, which will occur upon such stamping, may not cause fracture of the metal plate material, particularly at bridging portions between adjacent openings. Further, an additional operation is required to remove any yielding point elongation of the metal plate material caused by the annealing, by passing the metal plate material between roller levellers. After those operations, the stamping operation is performed. Thus, the prior process of production is very complicated (refer to a magazine "Iron and Steel", No. 2 of 1981, pp. 65–70).

Further, this process involves a problem of the homogeneity of a material of a metal plate itself. In particular, where there is some component segregation in a metal plate material, elongation upon stamping will not be uniform so that an uneven change in shape may appear around openings of the metal plate material, resulting in uneven transmittivity of electron beams. Since such unevenness of the material of a metal plate becomes clear after stamping, that is, after several steps such as annealing and levelling steps, production loss is significant. Besides, if crystal grains are too large after annealing, an uneven transmittivity of electron beams will be caused by stretcher strains. Therefore, elaborate and expensive examination of material lots becomes necessary.

Moreover, where the above process is employed, it is necessary in inital design to anticipate changes in the dimension and pitch of openings due to elongation of the material upon stamping. Thus, unstable elements are prominent. Further, upon designing openings, it is necessary to take into consideration a provision for avoiding appearance of a moire pattern due to an interference between so-called bridging portions between openings and a scanning line. Accordingly, designing of a color selection mechanism will be complicated by consideration of changes in pitch and shape of openings as described above.

In addition, in designing the segmental spherical face of such a color selection electrode, considerations of spring-back thereof will be necessary. In particular, when a metal plate material is drawn into a segmental spherical shape by stamping, it is deformed within a plastic region beyond the elastic limit thereof, and after such plastic deformation, an elastic restoration, that is, a spring-back, will appear. Accordingly, if stamping using a metal mold having, for example, a radius of curvature R is considered, the radius of curvature of an electrode finally produced produced will be $R+\Delta R$ which is greater by $\Delta R$ than the desired radius of curvature R. Accordingly, in order to finally obtain an electrode which has a segmental spherical face having a radius of curvature R, a metal mold for stamping it must necessarily be previously corrected for its radius of curvature involving such a spring-back as described above. Commonly, a metal mold is corrected or modified several times before an electrode having a face of a desired radius of curvature can be produced by stamping with the metal mold. Such corrections or modifications of a metal mold are very troublesome. Besides, since a degree of a spring-back will vary also depending upon variations in composition of the metal plate material, it is very difficult and troublesome to obtain a color selection mechanism of desired dimensions and a desired shape with consistent accuracy.

Meanwhile, patterns of fluorescent materials for individual colors in the form of dots or stripes which form a color fluorescent screen in a color cathode-ray tube are required to be disposed as uniformly as possible on an inner face of a panel 2*a* of the cathode-ray tube. Individual beams R, G and B are thus required to be selected by a color selection mechanism and landed respectively on the fluorescent materials of the corresponding colors. Separate applications of fluorescent patterns of individual colors on an inner face of a panel 2*a* are achieved using a well-known process that slurries of the fluorescent materials containing a photosensitive bonding agent are applied to an inner face of a panel, and then a color selection mechanism is mounted in position in an opposing relationship on the panel whereafter paths of electron beams are replaced by light to optically print the slurries of the fluoresent materials of the individual colors one after another using the actual color selection mechanism, or shadow mask as the light exposure mask.

As described above, in order to attain equal arrangements of fluorescent materials of individual colors, that is, in order to attain a condition appropriate for allowing individual electron beams R, G and B to be equally landed on the fluorescent materials of the respective colors, a color selection electrode 4 and a panel 2*a* must necessarily be arranged in a predetermined relationship.

Generally, there are two types of panels for color cathode-ray tube bodies: one is segmental spherical in its basic facial shape, and the other is cylindrical. Thus, in order to arrange a color selection electrode 4 and a panel 2*a* in an appropriate relationship to equalize arrangements of individual colors as described above, where a color selection electrode 4 is segmental spherical, preferably a segmental spherical panel 2*a* is used in combination. On the other hand, where a color selection electrode 4 is cylindrical, preferably a cylindrical panel 2*a* is used in combination.

A variation of color selection electrodes 4 of the cylindrical type has openings for passing electron beams which are formed as slits extending in a parallel relationship over the full vertical extent of an effective picture area. In the variation, a color selection electrode having slits formed therein is welded at opposite edges thereof in the extending direction of the slits to a pair of sides of a support frame which are curved along a cylindrical face of the frame so as to mount the color selection electrode in tension in a cylindrically curved condition on the support frame without involving a drawing operation as described above. While such troublesome operation as an annealing operation accompanying a stamping operation of a levelling operation as described above can be avoided with such a construction, since the color selection electrode is kept in tension thereby, the shape of the color selection electrode in the direction of the tension is limited to one which has a completely infinite radius of curvature, that is, to a straight one, which restricts the degree of freedom in designing. As a result, a panel section of a tube body which is used in combination with the color selection electrode of the construction described is also restricted in dimension and shape. Such restrictions will now be described. It is known that an appropriate distance $L_{SG}$ between an electrode 4 and a panel 2*a* for attaining appropriate arrangements of fluorescent material patterns of individual colors as described above, or in other words, an appropriate arrangement of landing positions on a panel 2*a* of electron beams R, G and B corresponding to the respective colors determined by a color selection mechanism, is given by an equation $$L_{SG} = \frac{P_G \cdot L_S}{3S_D} \quad (1)$$

where $S_D$ is a distance, where three electron beams R, G and B corresponding to red, green and blue are arranged, as viewed from the side of the panel 2*a* as seen in FIG. 1, in a horizontal straight line, between the centers of deflection $P_C$ and $P_S$ of a beam which is positioned centrally of the three electron beams R, G and B and the other beams positioned on opposite sides of the central beam, $P_G$ is a pitch of openings, and $L_S$ is a distance between the center of deflection $P_C$ and the fluorescent screen 3, and wherein $L_S$ and $S_D$ vary depending upon deflection of an electron beam. Thus, if the requirement of the equation (1) is met over the entire area of the fluorescent screen 3, landing positions of the three beams R, G and B are appropriately arranged over the entire area of the fluorescent screen 3.

Now, if landing positions $L_PR$, $L_PG$ and $L_PB$ of beams R, G and B on the fluorescent screen 3 controlled by the openings 4*a* of the color selection electrode 4, exhibit an appropriate arrangement as seen in FIG. 12A, where a distance between the panel 2*a* and the electrode 4 has a relation as seen in FIG. 12B, the landing postiions $L_PR$, $L_PG$ and $L_PB$ show a degrouping which expands at a corner portion of the fluorescent screen 3 as seen in FIG. 13A in case the radius of curvature of the panel 2*a* is large as shown in FIG. 13B, but in case the radius of curvature of the panel 2*a* is small as shown in FIG. 14B, an excessive grouping appears at a corner portion of the fluorescent screen 3 as seen in FIG. 14A. Actually, there may be some differences depending upon the pitch of openings or slits 4*a* of the color selection electrode 4, the deflection angle, the beam space of electron guns, and specification of deflecting means 7, but if it is intended to obtain patterns of fluorescent materials in the form of appropriately arranged stripes using a color selection electrode having a perfectly cylindrical face as described above, the shape of the panel 2*a* will be such that, for example, if a horizontal direction on a plane of the panel 2*a* is designated a direction of x axis, a vertical direction is designated a direction of y axis and a direction of the central axis is designated a direction z axis, the radius of curvature $R_{pyo}$ in the y direction across the z axis and the radius of curvature $R_{pys}$ of opposite sides positioned in parallel to the same having a relation $$R_{pys} < R_{pyo} \quad (2)$$

while the radius of curvature $R_{pxo}$ in the x direction across the z axis and the radius of curvature $R_{pxs}$ of opposite sides positioned in parallel to the same having a relation $$R_{pxs} < R_{pxo} \quad (3)$$

In fact, errors in dimension of a color selection electrode are small and an error in pitch $P_G$ is also small. Further, errors of the distance $L_S$ between the deflection center $P_C$ of a beam and the fluorescent screen 3 and the distance $S_D$ between the deflection center $P_C$ of the central beam and the deflection centers $P_s$ of the beams on both sides are small, and hence what matters more is an error due to variations of the radius of curvature of the glass panel. However, a panel section 1*P* is produced by molding a glass material which is molten at a high temperature, and in this case, since the radius of curvature and shape of panels 2*a* will vary, for example, with each lot, depending upon various conditions such as the temperature of glass and the cooling time will be selected in accordance with dimensions, resulting in lowering of production.

As described above, according to conventional processes of producing a color selection mechanism, when a segmental spherical color selection electrode is to be produced, a complicated production process is required. On the other hand, when a perfectly cylindrical color selection electrode is to be produced, a complicated adjustment of the shape of an inner face of a panel or selection of panel is necessary.

SUMMARY OF THE INVENTION

It is an object of the present invention to provide a process of producing a color selection mechanism for a cathode-ray tube which can eliminate or reduce such problems as described above.

According to the present invention, a color selection mechanism is produced by merely bending a color selection electrode made of a thin metal plate which has electron beam passing openings perforated therein into a curved facial shape within, and not beyond the elastic limit of the plate material and mounting the color selection electrode on a support frame. Thus, the present invention contemplates facilitation of production and improvements in available percentage and accuracy of completed color selection mechanisms.

In particular, in order to obtain a color selection mechanism for selecting landing postiions of electron beams on a flourescent screen as described in connection with FIG. 1, at first a plurality of electron beam passing openings are perforated in rows and columns in a predetermined pattern in a cold rolled thin metal plate having a material thickness of 0.08 mm to 0.35 mm using a well-known technique of high accuracy such as, for example, photo etching, to produce a color selection electrode, and then the color selection electrode is placed on a support frame which has a forward end face generally formed, for example, into a cylindrical face as a basic facial shape whereafter the electrode in the form of a thin plate is curved to extend along the forward end face of the frame by a mere bending operation within an elastic limit in which a drawing effect will not appear. In other words, the color selection electrode in the form of a thin plate is curved to have a substantially cylindrical face as a basic facial shape. And then, the electrode is welded to the frame at a portion of the electrode at which it is abutted with the forward end face of the frame.

A color selection mechanism is obtained in this manner which is supported on the frame and has the color selection electrode of a substantially cylindrical face as a basic facial shape, It is to be noted that the basic facial shape here denotes a shape generally approximate to a cylindrical face which has a required radius of curvature in one direction, for example, in a horizontal direction while in another direction perpendicular to the one direction, for example, in a vertical direction, the radius of curvature thereof is infinite, or very large comparing with that in the horizontal direction, or else the face is curved only at corner portions thereof.

The openings of the color selection electrode are either elongated or circular holes and are formed in rows and columns, thereby to eliminate the necessity to form the openings into slits which extend over an entire extent of an effective picture are in one direction.

Thus, since operations such as, for example, heat treatment at a high temperature for annealing and processing with levellers become unnecessary, production steps can be simplified, and problems of rejects and dependability due to segregation of components involved in stamping can be avoided. Further, since a drawing operation is eliminated, that is, since a material of an electrode is not subject to an elongation, a distance between adjacent openings, that is, a width of a bridging portion, can be reduced to one half, or so, of that of a conventional electrode. As a result, an influence of such a bridging portion can be avoided from being had on a picture area while it depends also upon a distance between a color selection electrode and a panel. Besides, since a pitch of openings can be made greater than that of a conventional color selection electrode, the problem of a moire with a scanning line can be improved. Accordingly, an inconvenience that different color selection mechanisms are conventionally contained in cathode-ray tubes for different destinations depending upon differences of broadcasting systems such as NTSC, PAL and SECAM in order to eliminate moires can be avoided by a common color selection mechanism which can be applied to such different cathode-ray tubes, resulting in improvement in mass production and also in reduction of costs.

Meanwhile, in a color cathode-ray tube, the total area of openings of a color selection electrode is about 20% to the entire area of the electrode, and most of electron beams which pass through openings of the electrode are converted into light while the remaining part, that is, about 80% of the electron beams strikes the color selection electrode and most of it is converted into heat. Thereupon, thermal expansion appears to the electrode, and extension thereof (doming) appears. As a result, dislocation of the electron beams (mislanding) appears. This is a phenomenon that is inevitable with a color selection electrode made of a steel plate or a thin metal plate which has been processed by heat treatment, that is, an annealing operation. However, a cold rolled thin metal plate is in a work hardened condition as it is, that is, there exists a residual stress in a cold rolled thin metal plate, and hence a resistance to deformation is high. Accordingly, in the case of a color selection mechanism which is made by providing a bending moment to a cold rolled thin metal plate according to the present invention, if there occurs a rise of temperature at the color selection electrode upon operation of the cathode-ray tube, the quantity of deformation is small even comparing with a conventional color selection mechanism which is made by annealing and then by stamping. Therefore, a cathode-ray tube having reduced mislanding can be provided. While a panel is molded in a metal mold with glass material which is resolved at a high temperature, a swelling having a different dimension from a reference dimension (curvature) (such a swelling is commonly called a "suck-up") will appear at a peripheral portion of an inner face the panel, particularly at opposing corner portions where the panel is of a rectangular shape. In such a case, the proper distance $L_{SG}$ between the electrode 4 and the panel 2*a* must necessarily be curved to complement the swelling. In the case of the present invention, while the basic shape is a cylindrical face, a proper distance $L_{SG}$ can be attained only by curving corner portions of a panel. The problem of variation of the curvature of a panel can be eliminated or reduced, and thus, a cathode-ray tube wherein fluorescent materials for individual colors are arranged equally can be provided Further, according to the invention, the facial shape of a color selection electrode is a cylindrical face in a basic shape, but it can be a shape which is not limited to a perfectly cylindrical face. Accordingly, the degree of freedom in designing to attain an appropriate relation between the color selection electrode and the panel, and hence adjustment of the shape of the panel section and the degree of freedom of selection of panel sections will increase

DETAILED DESCRIPTION OF THE PREFERRED EMBODIMENT

Figure 6:
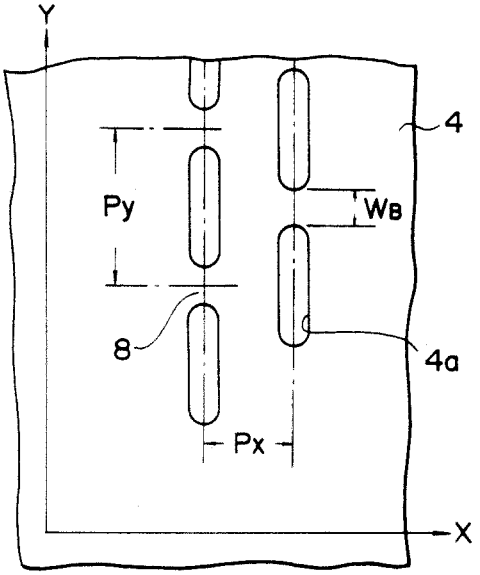
FIG. 6 is an enlarged diagrammatic representation showing a pattern of an example of color selection electrode produced by the process of the invention.

A plurality of electron beam passing openings 4a are formed in a thin metal plate, that is, a killed rolled steel plate such as, for example, a rimmed steel plate, a cold steel plate or an invar (35% Ni—the remaining Fe) plate using a well-known technique of photolithography. The electron beam passing openings 4a may each be in the form of an elongated hole having a longer axis in a vertical direction (y direction) as shown in FIG. 6 and are arranged in a plurality of vertical columns in a predetermined pitch $P_X$ in a horizontal direction (x direction) and also in a spaced relationship by a distance $W_B$ and in a predetermined pitch in the vertical direction in each of the vertical columns.

The openings 4a in two adjacent columns are arranged in an alternate relationship in order to prevent bridging portions 8 between adjacent openings 4a in all the columns from being arranged in the same horizontal scanning lines.

Figure 1:
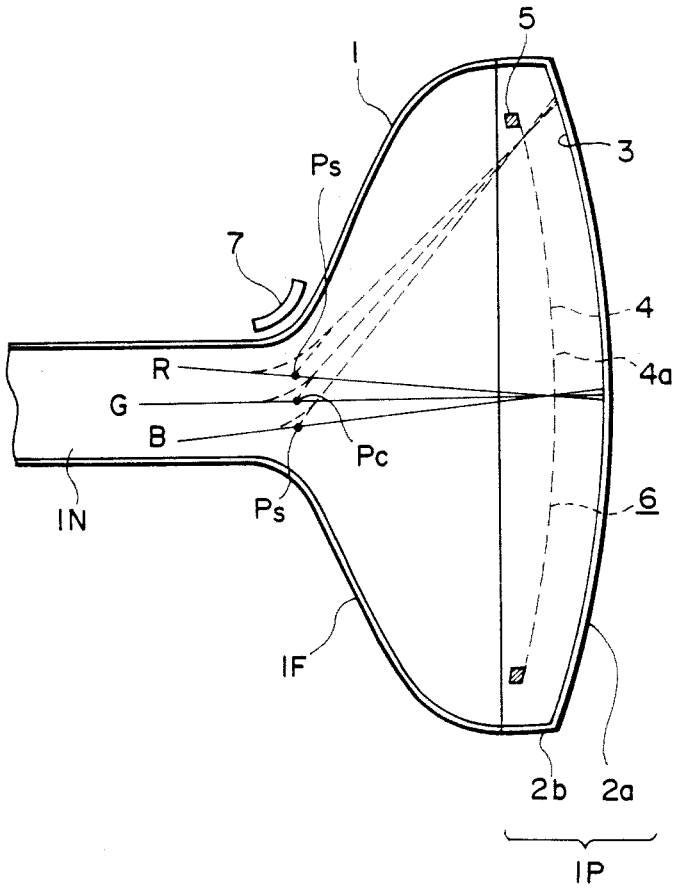
FIG. 1 is a diagrammatic representation showing a cathode-ray tube to which the present invention is applied.
Figure 2:
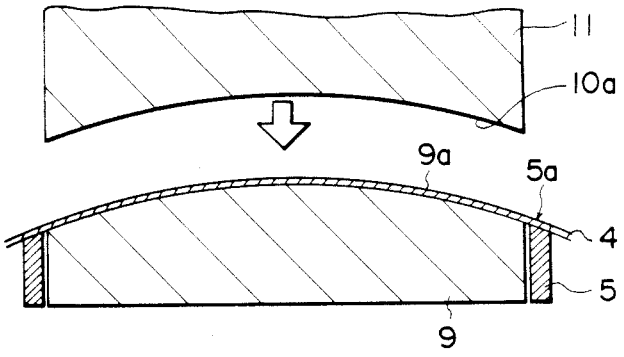
FIG. 2 is an enlarged cross-sectional view illustrating a step of the process according to the invention.
Figure 3:
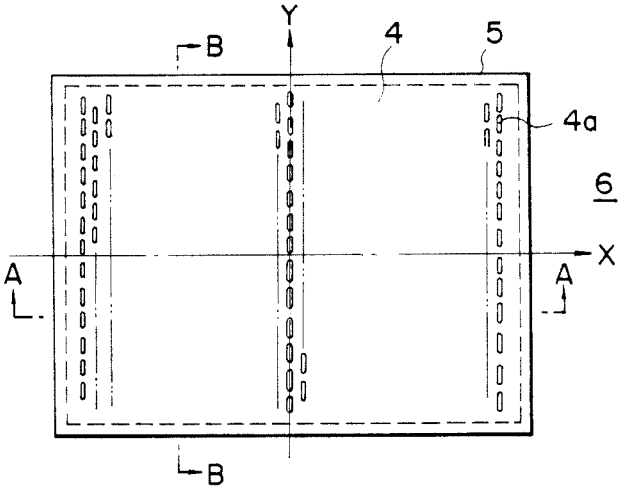
FIG. 3 is a front elevational view showing a color selection mechanism produced by the process of the invention.
Figure 4:
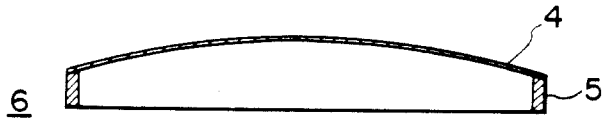
FIGS. 4 and 5 are cross-sectional views taken along lines A—A and B—B of FIG. 3, respectively.
Figure 5:
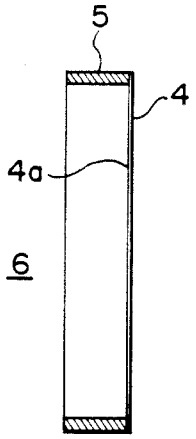

Then, the color selection electrode 4 produced from a thin metal plate in this manner is placed on a forward end face 5a of a support frame 5 as described hereinabove in connection with FIG. 2. In this case, a receiving table 9 having a receiving face 9a which is formed with a same curved face with the forward end face of the support frame 5 is disposed in the support frame 5, and the electrode 4 is placed to extend across and between the receiving face 9a of the receiving table 9 and the support frame 5 around the receiving table 9. Thus, the electrode 4 is curved from above along the curved faces of the receiving face 9a of the receiving table 9 and the end face 5a of the frame 5 by its own weight, or in addition, a pressing mold 11 having a concave face 10a complementary to the curved faces is pressed against the receiving table 9 to endure bending or curving the electrode 4 along the end face 5a of the frame 5 within the elastic limit of the electrode.

In this condition, the electrode 4 is welded linearly or at spots along the end face 5a of the support frame 5 at a portion of the electrode 4 abutting with the end face 5a of the support frame 5.

Figure 7:
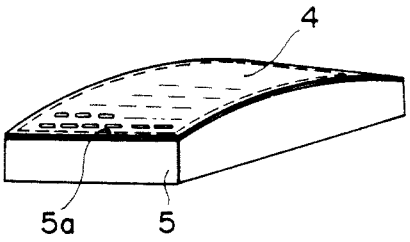
FIGS. 7 and 8 are diagrammatic representations illustrating a bending operation according to the process of the invention.
Figure 8:
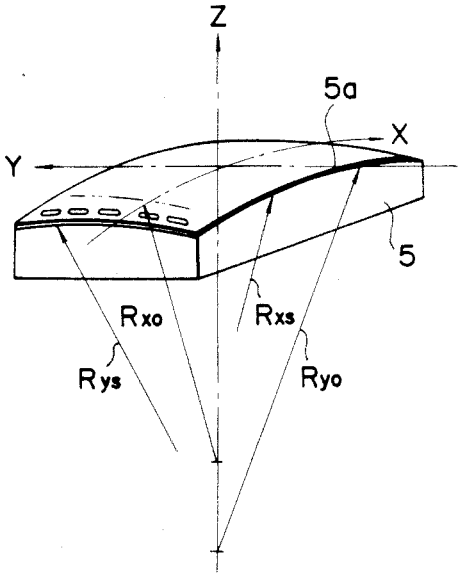

The shape of the curved face of the color selection electrode 4 by bending, that is, the shape of the end face 5a of the support frame 5, can be a perfectly cylindrical face as seen in FIG. 7, but it may be such that the radius of curvature in a sectional plane (Z-Y plane) containing the center axis Z and the vertical direction (Y direction) as seen in FIG. 8 (hereinafter referred to as the radius of curvature in the Y direction) is greater than the radius of curvature in a sectional plane (Z-X plane) containing the center axis Z and the horizontal direction (X direction) (hereinafter referred to as the radius of curvature in the x direction and where the radii of curvature at the center and peripheral portions are represented $R_{yo}$ and $R_{ys}$, and $R_{xo}$ and $R_{xs}$, there can be a relation of $R_{yo} > R_{ys} > R_{xo} > R_{xs}$.

Consider as an example, obtaining a color selection mechanism including a color selection electrode 4 having a curved face which have different radii of curvature in the x and y directions and wherein the raduius of curvature is different at the center and at an outer portion thereof.

Figure 9:
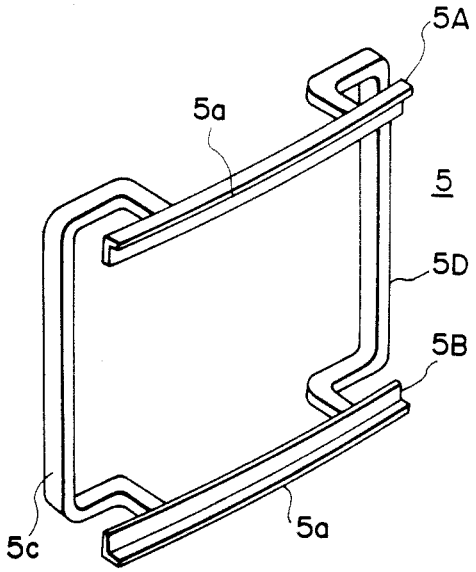
FIG. 9 is a perspective view of an example of frame which is used in the process of the invention.
Figure 10A:
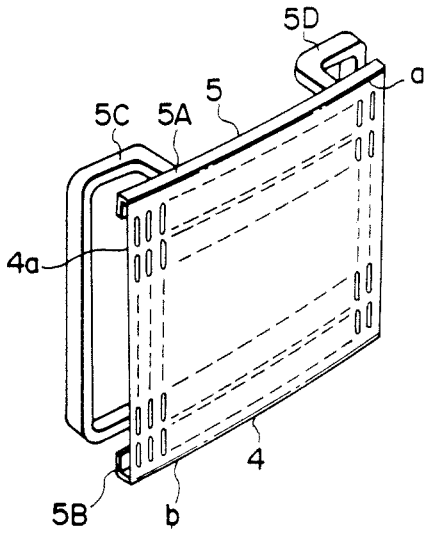
FIG. 10A through 10C illustrate successive stages in the formation of the color selection electrodes.
Figure 10C:
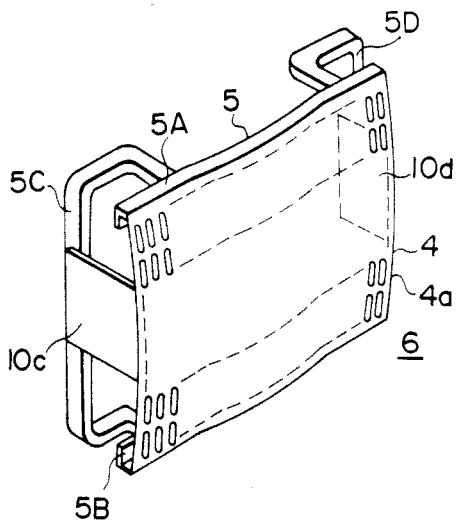

In this case, the support frame 5 is provided with a pair of opposing frame sides, for example, frame sides 5A and 5B extending in the horizontal direction, supported on a pair of arms 5C and 5D as seen in FIG. 9. Forward end faces 5a of the frame sides 5A and 5B are formed to have a common cylindrical face, for example, a cylindrical face which is reduced in radius of curvature toward opposite ends thereof A color selection electrode 4 which has openings 4a perforated therein is abutted with the frame 5 over the forward end faces 5a of the frame sides 5A and 5B of the latter as seen in FIG. 10a to curve the color selection electrode 4 in conformity with the shape of the front end faces 5a of the frame 5, and the color selection electrode 4 is welded to the front end faces 5a of the frame sides 5A and 5B of the frame 5 along chain lines as indicated at a and b in FIG. 10A. In this condition, opposite left and right sides of the frame sides 5A and 5B are pressed toward each other from outside as indicated by arrow marks c to f in FIG. 10B to flex the left and right sides of the electrode 4, and forward end faces of a pair of control plates 10C and 10D mounted on the arms 5C and 5D, respectively, and extending in the vertical direction (X direction) are abutted with a rear face along a pair of opposite left and right side edges of the electrode 4 as shown in FIG. 10C. The forward end faces of the control plates 10C and 10D are formed as faces curved with a required radius of curvature, and the electrode 4 is thus allowed to keep the required facial shape by the frame 10 including the control plates 10C and 10D. The color selection mechanism 6 is constituted in this manner.

The control plates 10C and 10D are provided to attain a predetermined arrangement of the panel 2a and the color selection electrode 4, and in case an inner curved face of the panel 2a is distorted a little or the curvature is different between left and right portions of an inner curved face of the panel 2a, the control plates may be two different plates, or they may be identical ones mounted at different positions of the respective arms 5C and 5D.

Figure 11:
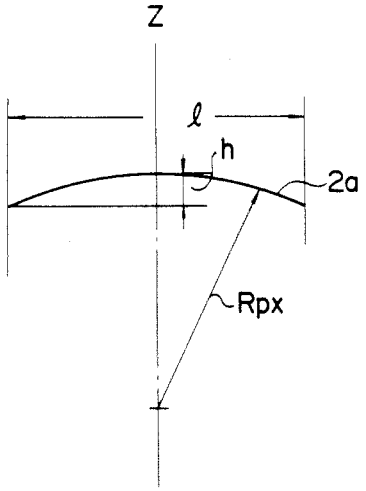
FIG. 11 is an enlarged diagrammatic illustration of a panel.
Figure 12A:
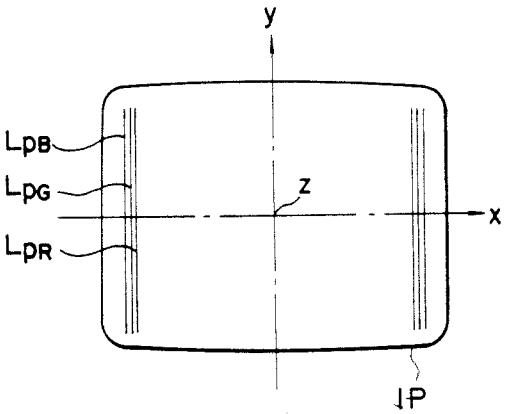
FIGS. 12A, 13A and 14A are front elevational views illustrating landing of a beam in a cathode-ray tube.
Figure 12B:
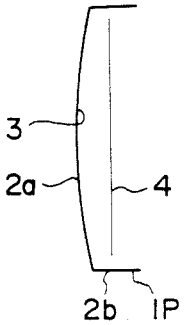
FIGS. 12B, 13B and 14B are diagrammatic side elevational views illustrating the relation of a panel section with a color selection mechanism of a cathode-ray tube.
Figure 13A:
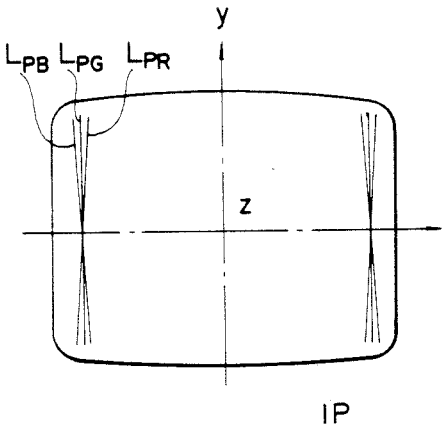
Figure 14A:
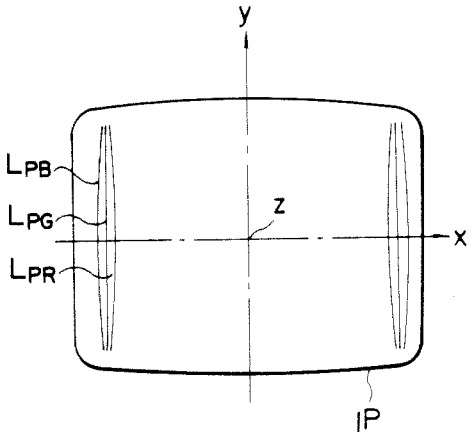
Figure 13B:
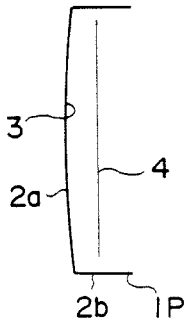
Figure 14B:
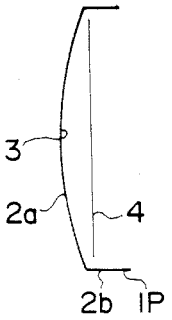

Meanwhile, if the panel 2a of the cathode-ray tube is examined, the panel 2a preferably has a cylindrical face, for example, a perfectly cylindrical face, as a basic facial shape and has a greater radius of curvature $R_{py}$ in the vertical direction (y direction) as far as possible than a radius of curvature $R_{px}$ in the horizontal direction (x direction) in order to avoid influence of external light on the picture area, particularly from the ceiling within a room. If the panel 2a of the cylindrical facial shape is examined, where the panel 2a has a perfectly cylindrical face, the height h of an arc of the panel 2a as shown in FIG. 11 within the x-z plane can be represented as $$h = R_{px} - \sqrt{R_{px}^2 - x^2} \quad (5)$$

where the lengths of each of arches in the x and y directions are $l_x$ and $l_y$, respectively. Shapes approximate to a cylindrical face as represented $$h = R_{px} + R_{py} - \sqrt{R_{px}^2 - x^2} - \sqrt{R_{py}^2 - l_y^2} \quad (6)$$

$$h = R_{px} - \sqrt{(R_{px} + R_{py} - \sqrt{R_{py}^2 + l_y^2})^2 - l_x^2} \quad (7)$$

$$h = R_{py} - \sqrt{(R_{py} - R_{px} + \sqrt{R_{px}^2 - l_x^2})^2 - l_y^2} \quad (8)$$

may also be possible. Provided, however, in each case, $R_{py} > R_{px}$. In case of the equations (6), (7), and (8), a barrel-type surface shape is provided Generally, shapes according to the equations (5) to (8) are used for a facial shape for panels 2a. It is to be noted that, in the case of a large cathode-ray tube, taking into consideration that the panel 2a may be deformed by the external air pressure when air is discharged from the cathode ray tube, a suitable radius of curvature R is provided to prevent the outer face of the panel 2a from being convexed into the cathode-ray tube after discharging air from within the tube. As for the inner face of the panel 2a, with the strength of the tube body after discharging air taken into consideration, the thickness of glass of the panel 2a is formed to increase from the center toward the periphery thereof while radii of curvature of the inner face of the panel 2a in every direction are selected to be a little smaller than those of the outer face of the panel 2a. Further, the facial shape of the inner face of the panel 2a may be a hyperboloid of two sheets of a higher order due to a characteristic of the deflecting means 7.

Figure 10B:
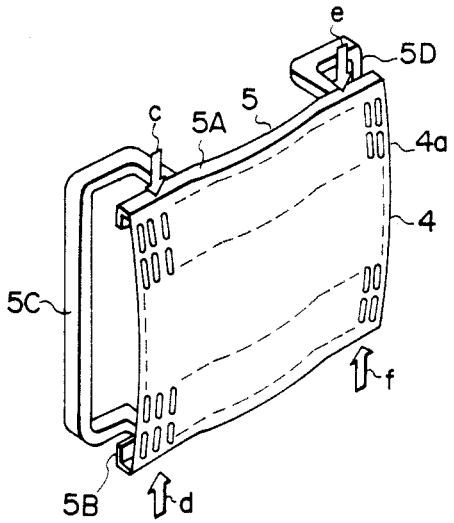

The panel 2a of an actual panel section 1P in most cases assumes no perfectly cylindrical facial shape due to several circumstances, and hence in order to attain equal arrangements of patterns of fluorescent materials of different colors over every area, it is suitable that the facial shape of a color selection electrode 4 is selected in accordance with the facial shape of the panel 2a to provide some changes to the radii of curvature in the X and Y directions without providing a perfectly cylindrical face to the color selection electrode 4. In such a case, by employing the production process as described in connection with FIG. 10, a color selection mechanism having a color selection electrode 4 which has an intended facial shape that is a cylindrical face as a basic facial shape can be constructed. It is to be noted that if the frame sides 5A and 5B in FIG. 10B are flexed by 0.022 mm at opposite left and right ends thereof, the height h can be increased by 1.251 mm, and where the arc length l is 100 mm, the radius of curvature of 1000 mm can be obtained, and the radius of curvature in the X direction which was initially 300 mm is changed to about 359 mm.

I claim as my invention:

1. A process of producing a color selection mechanisms for a cathode-ray tube, comprising the steps of perforating a plurality of electron beam passing openings in rows and columns in a cold rolled thin metal plate to form a color selection electrode, bending the color selection electrode within the elastic limit of the material of the electrode while said material still evidence residual stress into a curved facial shape having substantially a cylindrical face as a basic facial shape thereof without drawing said metal plate, and fixing the color selection electrode in that curved condition on a substantially rigid frame.

2. The process of claim 1 wherein the frame includes a pair of supported spaced generally cylindrically curved surfaces and opposite edges of said electrode are welded thereto.

3. The process of claim 2 wherein substantially rigid curved elements are positioned between said spaced cylindrically curved surfaces and retain a curvature of said electrode in a direction transverse to the curvature of the cylindrically curved surfaces provided by deflecting said spaced cylindrically curved surfaces toward each other.

* * * * *